US006203183B1

(12) United States Patent
Mordaunt et al.

(10) Patent No.: US 6,203,183 B1
(45) Date of Patent: Mar. 20, 2001

(54) MULTIPLE COMPONENT IN-LINE PAINT MIXING SYSTEM

(75) Inventors: Kane M. Mordaunt, Bellevue; Thomas R. Sim, Bothell, both of WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/298,347

(22) Filed: Apr. 23, 1999

(51) Int. Cl.[7] ..... B01F 3/08; B01F 15/04

(52) U.S. Cl. ..... 366/138; 366/152.1; 366/160.1; 366/182.4

(58) Field of Search ..... 366/138, 140, 366/152.1, 160.1, 160.2, 160.5, 162.1, 182.4, 142, 605; 700/265, 285

(56) References Cited

U.S. PATENT DOCUMENTS

| | | | |
|---|---|---|---|
| 2,865,614 | | 12/1958 | Nagy . |
| 2,894,732 | | 7/1959 | Taber et al. . |
| 2,923,438 | | 2/1960 | Logan et al. . |
| 4,019,653 | | 4/1977 | Scherer et al. . |
| 4,212,545 | | 7/1980 | Lovasz et al. . |
| 4,403,866 | * | 9/1983 | Falcoff et al. . |
| 4,408,890 | | 10/1983 | Beckmann . |
| 4,475,821 | | 10/1984 | Koch et al. . |
| 4,705,083 | * | 11/1987 | Rossetti et al. . |
| 4,729,664 | | 3/1988 | Kamiwano et al. . |
| 4,877,522 | | 10/1989 | Toei et al. . |
| 4,881,820 | | 11/1989 | Lückhoff . |
| 4,992,952 | | 2/1991 | Sasaki . |
| 5,023,814 | | 6/1991 | Guillemin . |
| 5,076,930 | | 12/1991 | Rubin . |
| 5,190,373 | | 3/1993 | Dickson et al. . |
| 5,302,325 | | 4/1994 | Cheng . |
| 5,304,001 | | 4/1994 | Kuo et al. . |
| 5,388,761 | | 2/1995 | Langeman . |
| 5,403,089 | | 4/1995 | Kuo et al. . |
| 5,464,283 | | 11/1995 | Davis . |
| 5,490,726 | | 2/1996 | Davis et al. . |
| 5,505,539 | | 4/1996 | Lee et al. . |
| 5,887,975 | | 3/1999 | Mordaunt et al. . |

* cited by examiner

*Primary Examiner*—W. L. Walker
*Assistant Examiner*—David Sorkin
(74) *Attorney, Agent, or Firm*—Christensen O'Connor Johnson Kindness PLLC

(57) ABSTRACT

An in-line mixing system and method for mixing one or more paint fluid subcomponents. The system includes subcomponent input lines (20) connected to a reducing manifold (22). An on/off solenoid valve (28) in each line is arranged to allow or prohibit fluid from entering the reducing manifold. The reducing manifold includes multiple input passages that converge to form a single output passage. A flow meter (26) is in communication with the manifold output passage to measure the flow of subcomponent fluid through the manifold. Using the flow meter, a control system (30) causes the input line solenoid valves to open and close to create a slugwise line of subcomponent fluids passing from the manifold output passage. From the reducing manifold, the slugwise line enters an integrator (32) where the subcomponents are partially mixed. A static mixer (34) connects to the output of the integrator to thoroughly mix the fluids. Preferred embodiments of a mixing system, an integrator, and an control instruction system are provided.

13 Claims, 13 Drawing Sheets

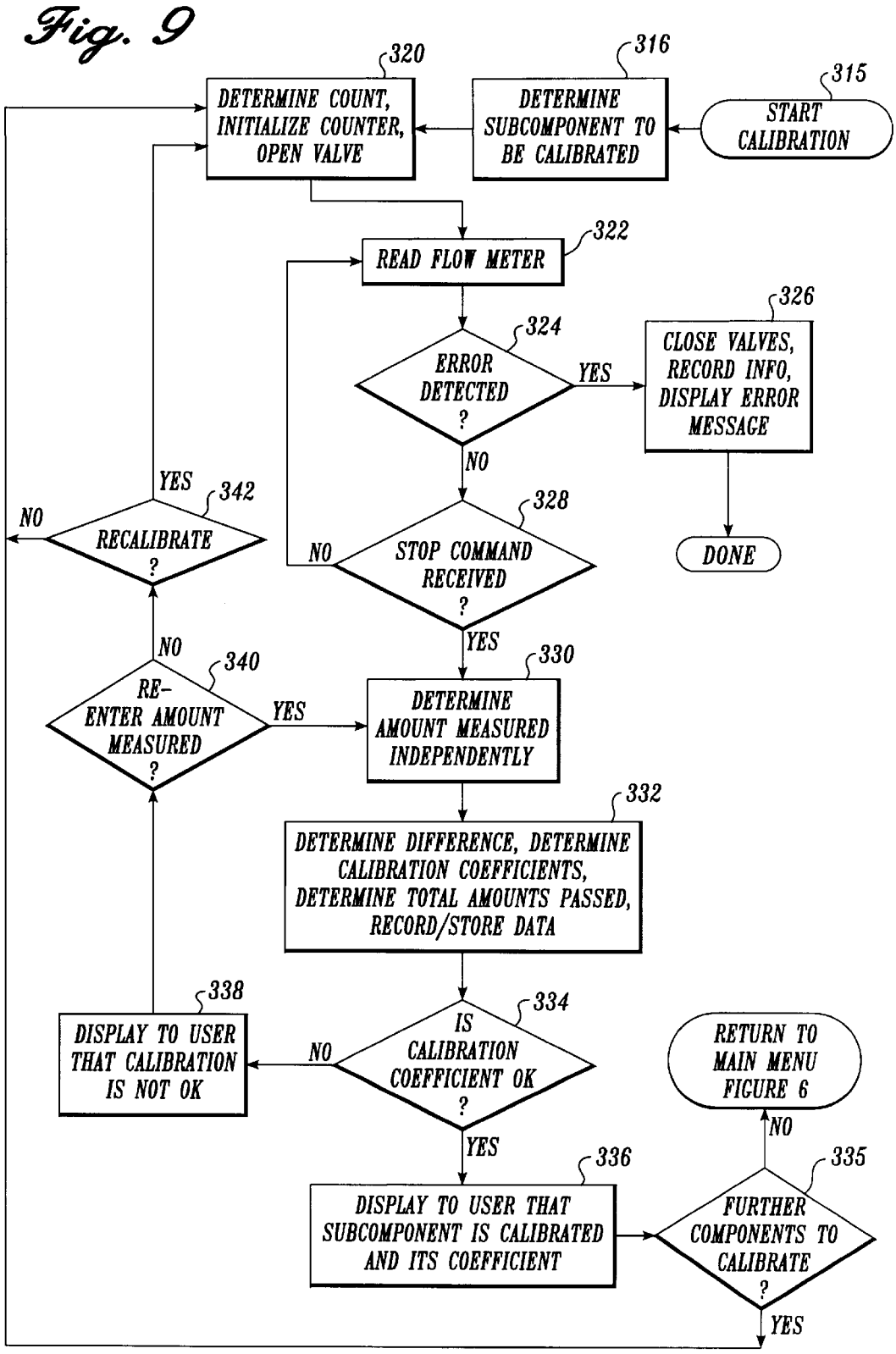
Fig. 9
315
START CALIBRATION
316
DETERMINE SUBCOMPONENT TO BE CALIBRATED
320
DETERMINE COUNT, INITIALIZE COUNTER, OPEN VALVE
322
READ FLOW METER
324
ERROR DETECTED ?
YES
326
CLOSE VALVES, RECORD INFO, DISPLAY ERROR MESSAGE
DONE
NO
328
STOP COMMAND RECEIVED ?
NO
YES
330
DETERMINE AMOUNT MEASURED INDEPENDENTLY
332
DETERMINE DIFFERENCE, DETERMINE CALIBRATION COEFFICIENTS, DETERMINE TOTAL AMOUNTS PASSED, RECORD/STORE DATA
334
IS CALIBRATION COEFFICIENT OK ?
NO
338
DISPLAY TO USER THAT CALIBRATION IS NOT OK
YES
336
DISPLAY TO USER THAT SUBCOMPONENT IS CALIBRATED AND ITS COEFFICIENT
335
FURTHER COMPONENTS TO CALIBRATE ?
NO
RETURN TO MAIN MENU FIGURE 6
YES
340
RE-ENTER AMOUNT MEASURED ?
YES
NO
342
RECALIBRATE ?
NO
YES

MULTIPLE COMPONENT IN-LINE PAINT MIXING SYSTEM

FIELD OF THE INVENTION

The present invention relates to mixing systems, and more particularly, to paint mixing systems for producing relatively small industrial quantities of paint from two or more paint subcomponents.

BACKGROUND OF THE INVENTION

Known aircraft paint mixing methods include the batch method and the in-line method. In the batch method, containers of cure (catalyst), flow (reducer), and base (resin) are prepared separately and then poured into a large container where they are manually stirred. After an induction waiting period, required for some paint systems, the paint is transported to the point-of-use where it is sprayed using hand-held pressurized spray guns. The containers are rinsed with solvent, left to dry, and then disposed of as waste.

In the in-line method, mixing is limited to two subcomponents. Separate lines of base and cure are fed into a small mixing container. Prior to reaching the mixing container, each paint subcomponent passes through an adjustable valve (e.g., a needle valve or a pneumatic valve) its own flow meter. A control system tracks the flow and adjusts the valves as needed to ensure the proper mix ratio. The mixing container mixes the subcomponents by passing the fluid through a static baffling or other torturous path. After the subcomponents are mixed in the container, the paint travels along an output line to a spray gun, as in the batch method.

In the aircraft industry, both current batch and in-line mixing methods have disadvantages. In the batch method, any unused material must be properly disposed of according to government regulations. The waste therefore adds unnecessary expense to the cost of producing a painted plane and to the environment. In the current in-line method, the flow meter and adjustable valves must be both extremely accurate and responsive in order to ensure a proper mix ratio of the fluid components. Such equipment tends to be mechanically complex and expensive. The extra mechanisms required for each component line also make the current in-line systems expensive. Extra solvent is needed to flush the additional parts during cleanup, which further increases the system's total waste. In addition, current in-line systems are generally designed to mix only two components. Popular polyurethane/epoxy aircraft formulations, however, often consist of three components (base, flow, and cure). Thus, it is necessary to batch mix two of the three components (i.e., the flow and cure), and then add the third component (base) in-line—a system that therefore suffers the disadvantages of both methods.

Thus, a need exists for an improved system of mixing two, three and even four fluid subcomponents (in particular, paint subcomponents) which is capable of producing a paint of a proper ratio on demand and without having to overmix the amount for a particular job. The ideal system would preferably consistently yield a product with less than about ±2% error in mix ratio error, and would be capable of mixing two or more subcomponents in-line without the need for batch mixing. Such an ideal system would receive the benefit of reduced costs of material supplies, reduced waste to the environment, and reduced need for cleanup solvent. The present invention is directed to such an ideal system.

SUMMARY OF THE INVENTION

The present invention in-line mixing system is provided for mixing multiple fluid subcomponents, and particularly, for mixing paints having two or more fluid subcomponents. An in-line mixing system formed in accordance with the present invention includes multiple subcomponent input lines. Each line includes a valve having open and closed positions for allowing and prohibiting the flow of subcomponent through the input line. The mixing system further includes a reducing manifold including multiple input passages. One subcomponent input line is connected to each manifold input passage. The multiple input passages converge to form a single output passage. A flow meter is in communication with the manifold output passage and measures the flow of subcomponent through the output passage. During use, a slugwise line of subcomponents is formed by alternatingly opening and closing the input line valves. Mixing components connect to the output of the flow meter to combine the slugwise subcomponents into paint.

In accordance with other aspects of this invention, the preferred flow meter is a positive displacement gear-type flow meter. The mixing components preferably include an integrator connected to the output of the flow meter and a static mixer connected to the output of the integrator. A paint output line is connected between the static mixer and a spray gun. The paint within the output line may be optionally pressurized by an output pressure pump. The mixing system preferably further includes a control system having a controller in communication with the flow meter and the input line valves. The input line valves are switched between their open and closed positions by the controller. The control system monitors the flow meter, determines the amount of each subcomponent, and switches the valves accordingly to result in the appropriate subcomponent mix ratio. Where the input line valves are solenoid valves, the controller is capable of electrically switching the solenoid valves between their open and closed positions. A computer is provided for user interface in operating the control system.

In accordance with further aspects of the invention, one preferred embodiment of the mixing system includes three subcomponent input lines, with each line including a solenoid valve. The reducing manifold includes three input passages. One subcomponent input line is connected to each input passage, the input passages intersecting to form a single output passage. A flow meter is in communication with the manifold output. The output of the flow meter is connected to an integrator where partial mixing of the subcomponents occurs. The system further includes a static mixer that is connected to the integrator output. The static mixer more thoroughly mixes the components. The solenoid valves, manifold, flow meter, integrator, and static mixer are located in a first compartment of a housing.

In accordance with still other aspects of the invention, the first preferred embodiment further includes a check valve connected between each solenoid valve and the manifold. A control system is provided and includes a controller located in a second compartment of the housing. The second compartment is positively pressurized by an air purge unit. The amount of pressurization is in the range of about 0.6 inches of water to about 4 inches of water.

In accordance with still further aspects of this invention, a unique integrator is provided for use in mixing paint fluid subcomponents. The integrator includes a sealed container having an input port and an output port, an influent tube positioned within the container and connected to the input port, and an exfluent tube positioned within the container and connected to the output port. Both the influent and exfluent tubes include a series of longitudinal holes and one in the closed end of each. The sealed container is pressurized according to the supply pump outputs. To accommodate the pressure increase in fluid flowing along the influent tube to its closed end, the influent holes preferably decrease in size in going from the input port to the influent tube closed end. Likewise, the exfluent holes preferably increase in size in going from the output port to the exfluent tube closed end. Both the influent and exfluent holes decrease and increase nonlinearly in size, respectively. The integrator is sized to hold about ~250 cc of fluid.

In accordance with yet other aspects of this invention, a method of mixing paint from multiple paint fluid subcomponents is provided. The method includes forming a line of unmixed subcomponent slugs using a reducing manifold. The manifold includes multiple input passages that converge to form a single output passage. A single flow meter is in communication with the manifold output passage. A particular quantity of subcomponent is input to the manifold input passages. The quantity is measured by metering the amount of fluid passing from the output passage using the flow meter. The method further includes mixing the slugwise subcomponents by using an integrator and/or a static mixer. The flow of fluid subcomponent entering the manifold is accomplished by the opening and closing of solenoid valves that are in communication with each of the manifold input passages. The mix system is capable of mixing one, two, or three or even four subcomponents.

In one embodiment of the method, the integrator includes a sealed container, an influent tube located within the container and having a series of holes, and an exfluent tube located within the container and having a series of holes. The integrator partially mixes the fluids by passing the subcomponent slugs from the reducing manifold and flow meter to the influent tube and out the influent tube holes into the container. The fluid then passes into the exfluent tube holes and out of the exfluent tube and integrator. The influent and exfluent holes preferably vary in size to accommodate pressure differences in the tubes.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 9 is a logic diagram of the Calibration selection listed in FIG. 6.

DETAILED DESCRIPTION OF THE PREFERRED EMBODIMENT

The present invention is a system of mixing fluid subcomponents, and particularly paint fluid subcomponents for use in industrial paint spraying applications. By mixing paint subcomponents in the manner of this system, relatively small amounts of paint may be formed. This reduces the amount of materials needed to form the paint and the amount of waste left after a job is complete. The invention is therefore particularly important for those industries in which relatively smaller paint quantity requirements are the norm, e.g., aircraft manufacturers, auto shops, farm equipment manufacturers, household appliance manufacturers, and others.

Below is a description of the present invention mixing system and method with reference to FIGS. 1A–1B. Following, is a description of one embodiment of a particular mixing system formed in accordance with the present invention. This embodiment is shown with reference to FIGS. 2A–10. For the reader's convenience, several terms are defined as follows. Cure or catalyst refers to the isocyanate or amine cure component of an enamel and primer formulation, respectively. Base or pigment refers to the polymerizing component which generally contains the color pigment. (Even though the base contains the true catalyst, for convention's sake it is labeled base herein.) Flow, reducer, or solvent thinner refers to the paint thinner component which contains a mixture of various solvents.

Figure 1A:
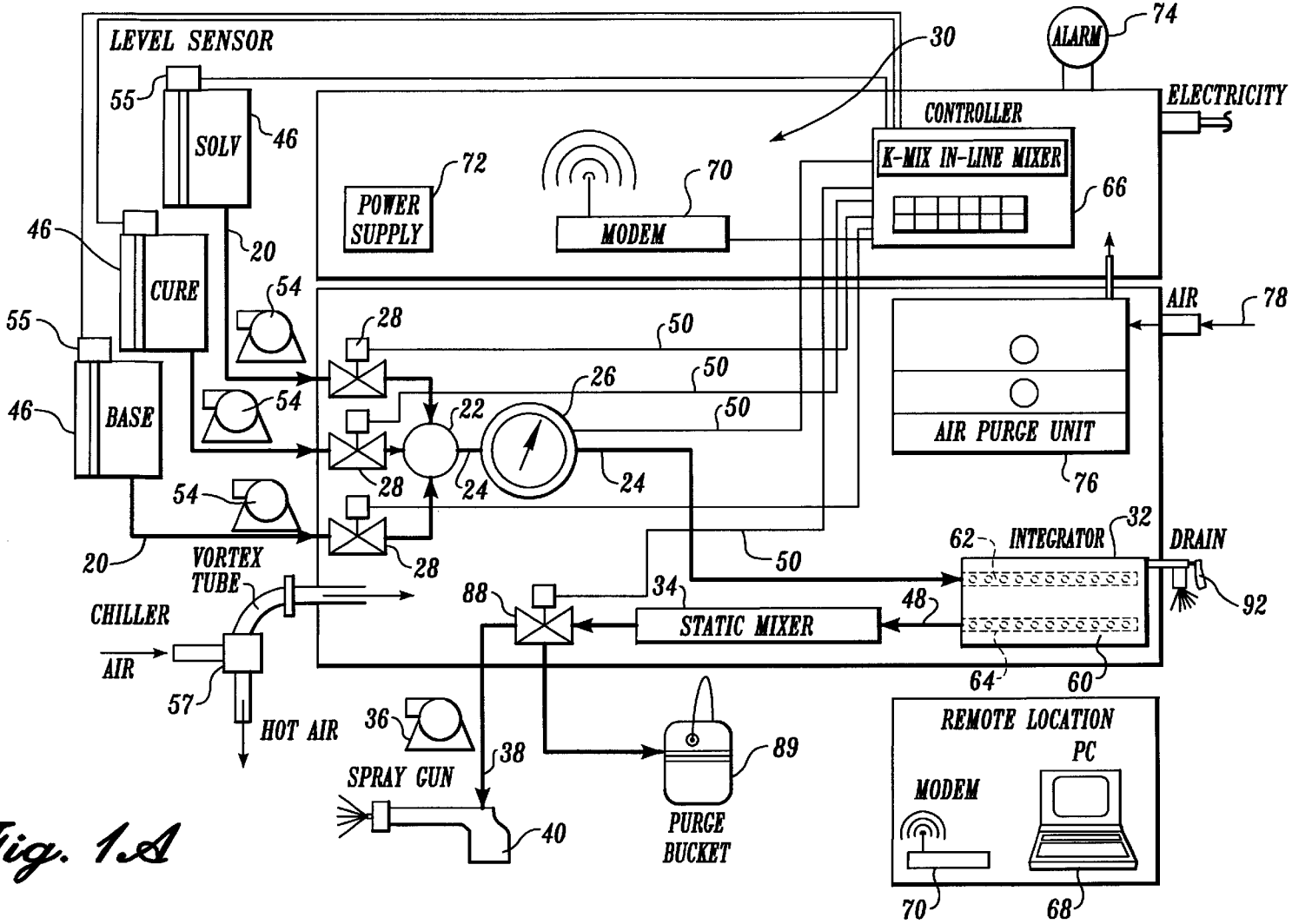
FIG. 1A is a schematic diagram of an in-line paint mixer formed in accordance with the present invention.
Figure 1B:
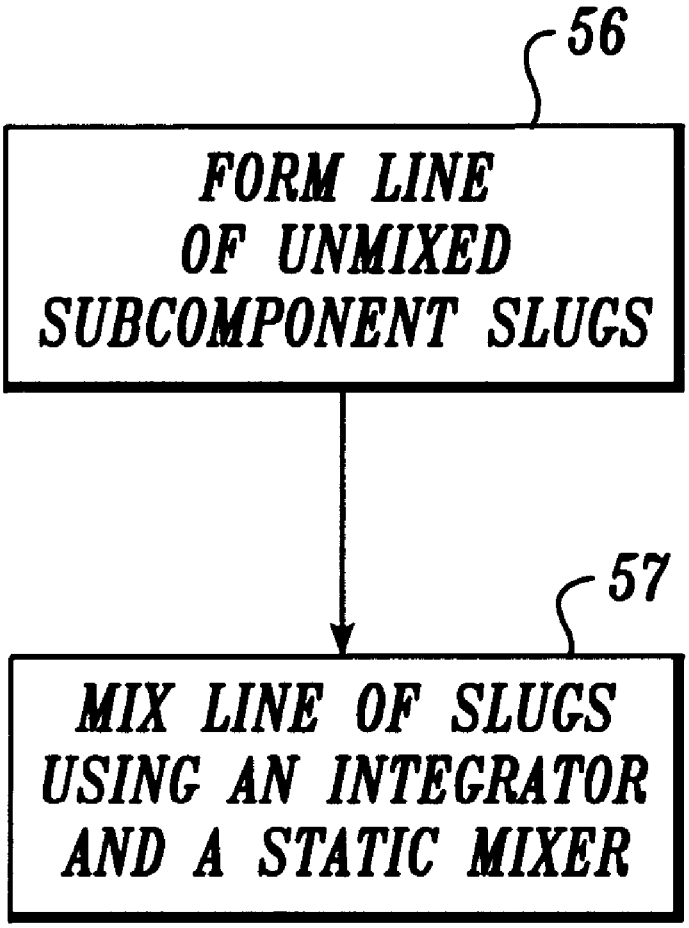
FIG. 1B is a flow diagram of a method of preparing paint formed in accordance with the present invention.

Referring to FIG. 1A, the present invention mixing system generally includes pressurized subcomponent input lines 20 connected to a reducing manifold 22. The manifold 22 reduces the number of inputs to a single output line 24 that passes through a flow meter 26. Valves 28 are placed in each input line 20 near the manifold 22. A control system 30 switches the valves 28 on and off in a predetermined manner to create a continuous flow of alternating subcomponent fluid slugs exiting the manifold 22. From the flow meter 26, the slugs pass to an integrator 32 where the slugs are roughly proportioned and partially mixed, and then to a static mixer 34 for more thorough mixing. A static mixer output line 38 connects the output of the static mixer to a spray gun 40, where the paint is there available for ejection onto an application surface. An optional output pressure pump 36 may be used to provide additional pressurization to the paint in the static mixer output line 38 where desired.

In more detail, referring to the left hand side of FIG. 1A, separate containers 46 supply fluid subcomponents to the present invention in-line mixing system. If possible, it is preferable to use bag containers instead of cans containers in order to reduce waste. For polyurethane/epoxy type paints, there is one container each of base, flow, and cure subcomponents. The subcomponents are supplied to the mixing system by the separate input lines 20. Movement of the fluid from each container into the input lines 20 may be initiated by available means, such as gravity, house air pressure, or nitrogen pressure. Once in the input lines 20, the fluid is moved to the mixer via conventional pressure pumps 54 connected to the input lines. The pumps additionally assure reliable loading of the manifold 22 and flow meter 26. Example pumps include air-operated double diaphragm pumps, piston pumps, pressure pots, etc. Depending on the complexity of the control system 30 and the sophistication of its sensing devices, it is generally desirable to pressurize the fluids to equivalent levels. Filters (not shown) may also be inserted along the input lines 20 to remove particulate contamination in the subcomponents.

Still referring to FIG. 1A, each input line 20 passes fluid through its own dedicated valve 28 and into the reducing manifold 22. Preferred valves 28 are electronically-controlled two position (on/off) switches biased in the closed position, such as the direct-acting solenoid valves shown in FIG. 1A. When the valve is opened, the subcomponent is allowed to enter the manifold 22. When the valve is closed, the subcomponent is blocked from entering the manifold 22. Other, more sophisticated types of valves may be used in lieu of solenoid valves or other on/off switches. However, complicated valves are not required in a mixing system formed in accordance with the present invention. What is important is that the valves be able to open and close quickly.

The manifold 22 is formed with the appropriate number of inlets, but only one outlet. In preferred embodiments, the manifold is a machined metal block with subcomponent input passages that centrally connect to form a single output passage. (See, for example, the embodiment shown in FIG. 5A.) The manifold 22 and valve 28 configuration is preferably designed so that the distance from the outlet of each valve to the outlet passage of the manifold is minimized. This lessens the dead volume in which unwanted diffusion mixing may occur. As such, the outlets of the valves 28 are preferably made to fit directly into the inlets of the manifold. In some designs it may be desirable to include a check valve between each valve 28 and its manifold inlet to prevent unwanted catalyzed paint from backflowing into the valve 28. (See, for example, check valve 110 in FIG. 3B.)

Only one subcomponent fluid is allowed to enter the manifold output passage at a time. Therefore, one valve 28 will open and close before the next valve is opened and closed. By alternating the opening and closing of the individual valves, the subcomponents are forced into and out of the manifold 22 in small quantities, or slugs. This produces a line of unmixed subcomponent slugs as indicated in step 56 of FIG. 1B.

The slug size of a particular subcomponent is based on the desired mix ratio. For example, with a 4:3:1 (base:flow:cure) mix ratio, the cure is assigned the smallest slug size of one. The slug sizes of the other components are scaled up appropriately. The minimum slug volume is determined by a number of factors, including solenoid valve reaction time and the overall paint flow rate. As slug size decreases, the subcomponent valves must react more quickly or the paint flow rate must decrease in order to maintain accurate slug volumes. Conversely, if the minimum slug size is too large, the integrator will not hold enough slug batches to provide good proportioning. The integrator is preferably sized to hold approximately three complete micro-batches.

Ideally, the combined volumes of the dead-leg fluid paths (i.e., the lines between the valves and the flow meter) should be less than the minimum slug size for any mix ratio. If the combined dead-leg volume is larger than the minimum slug size, then errors may occur when mixing paint whose components vary widely in viscosity. The errors are due to preferential flow of less viscous fluid from the dead-legs. To eliminate preferential flow, the combined dead-leg volume must be less than the minimum slug size and the fluid lines must be sized to minimize pressure drop such that the output pressure pump 36 does not pull a vacuum through the system.

The manifold 22 is not meant to mix the subcomponents, but only to provide an intersection where the subcomponents can meet and flow slug-wise, one behind another, in single-line through the manifold output passage and to a single flow meter. By making the subcomponent input slugs, however, some degree of crude mixing is accomplished in the sense that there is less mixing required downstream. It is more accurate, however, to characterize the manifold 22 as providing a continuous flow of unmixed micro-batches.

Referring back to FIG. 1A, the manifold 22 is connected to the integrator 32 through the manifold output line 24. Positioned along this line 24 is the flow meter 26, which measures the volume of fluid flowing from the manifold at any given time. The flow meter then relays this information to the control system 30. In alternative embodiments, the flow meter may be positioned in the system after the static mixer. Preferred embodiments, however, have the flow meter placed immediately following the reducing manifold. Based on the flow meter information, the control system switches the valves 28 open and closed when the appropriate fluid amount has been metered. Only one valve is open at a time, thus, the use of fast solenoids is important so that the manifold 22 produces a continuous on-ratio stream of fluid.

The flow meter should be constructed of appropriate material and be able to handle the particulate nature of pigment bases with-out jamming. Flow meters with few fluid-exposed moving parts and with reduced fluid-trapping interstitial spaces are best. Positive displacement type flow meters work well, as do mass flow meters with no moving parts (although they are generally more expensive.) The preferred flow meter is a positive displacement gear-type flow meter in which the only moving parts are two metering gears. There are no moving bearings, the flow meter is less expensive, and the flow path is specifically designed to minimize fluid trapping. As each gear tooth rotates, a Hall-effect sensor produces an electrical impulse that is converted and sent to the controller via an electrical link. From the accumulation of signals, the controller can calculate volumetric flow. When the rotation count reaches a setpoint value, the valves are switched by the control system 30 to flow the next slug of material. The flow meter is preferably designed to tight machine tolerances so that changes in material viscosity do not lead to significant flow errors.

As material passes the flow meter, some may become entrained in small spaces and cause problems if the material cures and jams the precision tolerance metering gears. Thus, when possible, the user should avoid running two slugs of base and cure adjacent to one another. Instead, flow slugs are positioned between base and cure slugs so that mixing and, thus, paint activation do not occur to a significant degree. For three component epoxy-type formulations, the order in which subcomponent slugs are valved is therefore: flow, base, flow, cure, flow, base, and so forth. Preferably, the base and cure are separated by as much flow as the mix ratio will allow, especially when highly viscous bases and cures are used. The reducer flow acts as a solvent wash, removing base and cure residue, and preventing unwanted cure reactions in the flow meter.

To ensure proper measurements by the control system 30, the mixing system mechanisms must be accurately calibrated prior to use. This is accomplished by running each subcomponent through the flow meter 26 and siphoning it off to be measured. In the illustration of FIG. 1A, each subcomponent is siphoned it off through a drain valve 92 connected to the integrator 32. Other arrangements for siphoning fluid may be used, such as an automatic syringe pump. Fluid is dispensed one subcomponent at a time through the flow meter 26 and out the drain valve 92. The fluid is collected and volumetrically measured in a graduated cylinder. During fluid passage through the flow meter 26, the control system 30 records the volumetric flow as metered by the flow meter 26. The cylinder measurement is compared to the control system value. If the actual and predicted volumes are within a desired tolerance of each other, the system is calibrated. If the two measurements are not within the tolerance, the control system 30 and/or flow meter 26 should be updated accordingly.

As stated above, in practice, the flow meter may be located anywhere between the solenoid valves and the output pressure pump. Placing the flow meter after the integrator or static mixer is possible and provides the advantage of requiring only one calibration on mixed paint instead of the three calibrations required for the individual subcomponents. This system, however, then requires an additional check to verify the mix ratio.

From the flow meter 26, the slug-wise line of subcomponents enters the integrator 32 where the slugs are initially mixed. The integrator preferably includes an enclosed interior space 60 having an inlet, an outlet, and two distributors 62, 64 positioned within the enclosed space. One distributor 62 is connected to the integrator inlet, and one distributor 64 is connected to the outlet. Material flows from the flow meter 26 into the integrator inlet where it is dispersed through the inlet distributor 62. The material circulates within the integrator 32 and eventually flows into the other distributor 64 and out the integrator outlet. The material flowing out of the integrator 32 is partially mixed.

The integrator 32 is designed to maximize the residence time of material slugs in a minimized volume so that the amount of paint waste is reduced. Therefore, the integrator is always full of fluid. To ensure a proper mix ratio, the integrator 32 is sized to account for the slugs flowing into the integrator at different times behind one another. The integrator is designed according to the flow rate, the approximate subcomponent diffusivity, and the volume the largest complete subcomponent micro-batch will fill. The integrator 32 is preferably sized about three times the maximum micro-batch size based on the minimum quantity used for a particular ratio. By proportioning the number of slugs of each subcomponent, the proper mix ratio is attained in the integrator.

Still referring to FIG. 1A, the partially mixed material next passes through an integrator output line 48 to the static mixer 34 which is designed to give thorough mixing according to a paint manufacturer's given specifications. Conventional static mixers may be used, and as such, are not described herein. The combination of the integrator and static mixer mixing is shown in step 57 of FIG. 1B.

As described above, the integrator partially mixes the fluid subcomponents. Initially, the fluid exiting the integrator has significant instantaneous error in its mix ratio. Over time, the mix ratio error will oscillate with some frequency within a stable band. The oscillating mix error is effectively averaged to zero by using the natural physical and chemical characteristics of a fluid traveling in a transport system, including reaction kinetics and radial and axial mixing in the static mixer, pump, paint output line, and spray gun.

Referring back to FIG. 1A, upon leaving the static mixer 34, the material flows along the static mixer output line 38 and is delivered to the conventional spray gun 40, where the paint is ready to be applied. The output pressure pump 36 optionally pressurizes the paint in the static mixer output line prior to the paint reaching the spray gun 40. The output pump 36 is preferably a high pressure double acting piston pump, with a pressurization of ratio of 10:1 or greater.

The goal of slugwise in-line paint mixing is analogous (though opposite) to the goal of flow injection analysis (see, for example, Ruzicka, J. and Hansen, E. H., "Flow Injection Analysis," 2nd Edition, Wiley & Sons, New York, N.Y. (1988)) in that a sample slug of fluid is injected between two surrounding carrier slugs. The slugs are transported into the integrator, mixed, then passed to the static mixer and output pressure pump. Along the flow path to the spray gun, molecular and convective diffusion will disperse the injected sample slug into each surrounding carrier slug providing some degree of mixing. Chemical reactions will further drive dispersion as concentration gradients and reduced viscosities from exothermic reactions are introduced. Finally, the physical configuration and dimensions of tubing, fittings, valves and pumps significantly affect dispersion.

Referring still to FIG. 1A, a conventional chiller 57 is provided to improve the pot life of the fluids by thermally slowing the chemical cure reaction. The chiller 57 of FIG. 1A is a vortex tube chiller that separates compressed intake air into cold and hot air portions. The chiller directs the cold air into the mixing system and directs the hot air away from the mixing system.

The above system mechanisms are preferably operated via a digital control system 30 that provides a means of electronically activating the valves 28. The control system 30 may be configured in various ways depending on the degree of control and information required in a particular application. At a minimum, the control system 30 includes elements that cause the component valves 28 to be opened and closed in the proper sequence, for the proper durations, and at the proper frequencies. Appropriate operation of the valves plus accurate information from the flow meter 26 allows the control system 30 to ensure that a proper mix ratio is achieved in the final paint product.

The control system 30 is optionally arranged to monitor the entire process and obtain data regarding the level of product and by-products produced. The user can then download information for statistical product analysis and obtain systems diagnostics information for maintenance and repair purposes. Data such as material usage, ratio performance, and volatile organic compound emissions may also be downloaded from the system for reporting purposes.

Referring to FIG. 1A, the control system 30 includes a controller 66 in electronic communication (via links labeled 50) with the subcomponent valves 28, the flow meter 26, and an output valve 52. Level sensors 55 are preferably used to sense the level of subcomponent fluid in a container 46 and relay the information to the controller 66. At low fluid levels, the controller alerts the user to replenish the supply and/or stops the mixing process as necessary. The mix ratio and other parameters of interest are programmed directly into the controller or into a remote personal computer 68 and relayed to the controller via modem 70. The controller may be modifiable to accommodate alternate configurations and mix ratios as required for other applications. The controller and/or computer can additionally include memory to store the data regarding the mixing system and the chemicals being produced. The data is reviewed visually on a computer screen and/or stored in computer memory for later inspection and manipulation.

The entire mixing system is powered from a shop electrical outlet via a power supply unit 72 included in the control system 30. By allowing the control system to control power to the valves 28, the system can stop the process at any time should an equipment error be detected or a stop command be instructed from an operator. In this regard, the control system preferably includes a number of error diagnostics capabilities for monitoring such items as the mix ratio, flow counters, brownouts, power disruptions, and parameter integrity to guard against program code corruption.

As will be recognized by those skilled in the art, the combination of electronic components and paint fumes presents a potential fire hazard. To avoid any such problems, it is important to either locate the control system electrical components a safe distance from the paint materials or to configure the mixing system so that there is no possibility of an electrical sparks occurring in or near volatile matter. Referring to FIG. 1A, the mixing system includes an air purge unit 76 capable of using a shop air supply 78 to continuously blow fresh air over all system components. The shop air supply may optionally be provided to an accessory air handling valve (not shown) to provide air to one or more accessory components (such as the output pressure pump 36.) The control system is preferably pneumatically purged at least four times before electrical power is applied. If a purge failure is detected, the purge unit 76 removes power from the controller system 30 and alerts the user by sounding an alarm 74. If a fault condition occurs, the controller connection to the valve 88 can immediately stop the flow of paint to prevent further spraying.

After finishing a paint job, the mixing system should be cleaned to prevent paint from forming or corroding the insides of the various system mechanisms. There are a number of different ways in which the cleaning can be accomplished. One method is to separate the base and cure containers from the system, but to leave the flow container connected and pressurized. The control system is activated to cause the opening of all three subcomponent valves to initiate flow movement therethrough. The flow, acting as a solvent, back-flushes the cure and base materials from the manifold and through the pressure pumps. This is done for a series of cycles, after which the base and cure valves are closed and the rest of the system is purged by activating the spray gun 40 and allowing flow to pass through the remaining system mechanisms. The control system configures the output valve 88 to divert the flushed fluid into a waste container 89.

Alternatively, the individual system components may be removed, cleaned separately, and then reassembled. Alternatively, a dedicated cleaning system may be provided in which an independent solvent source (not shown) is connected to each input lines 20 upstream of its respective valve 28. The independent solvent source is activated to flush all lines simultaneously.

In designing a mixing system in accordance with the present invention, a designer should consider optimizing the pressure drops between components to find the smallest useable fluid lines that minimize internal waste. For example for rates of 0.5 gallons per minute and base/flow/cure viscosities of about 1 to 800 centipoise, preferred pressure drops are: less than about 35 psi from the subcomponent input pumps 56 to the flow meter 26; about 25 psi through the flow meter 26; about 2.5 psi through the integrator 32; and about 3.5 psi through the static mixer 34.

One embodiment of an in-line mixing system formed in accordance with the present invention is provided with reference to FIGS. 2A–10. This embodiment is designed to mix two or more paint fluid subcomponents. An epoxy-type paint having subcomponents of base, flow, and cure is discussed below for illustrative purposes only. Other types of materials may be formed with this embodiment. The system works best for fluids having viscosities of about 800 centipoise or less.

Figure 2A:
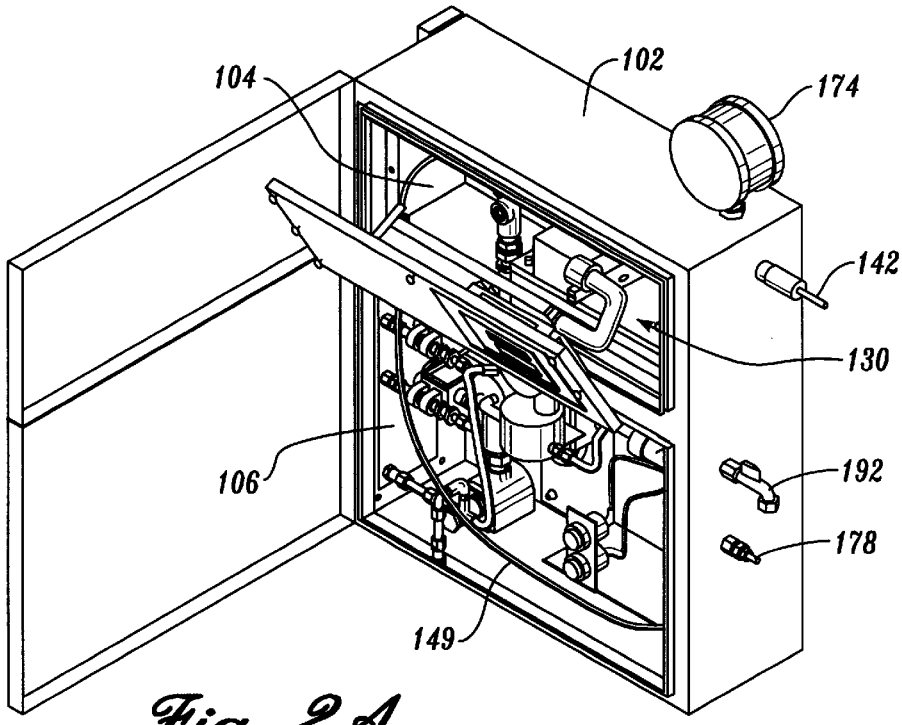
FIG. 2A is a perspective view of one embodiment of an in-line paint mixer formed in accordance with the present invention.
Figure 2B:
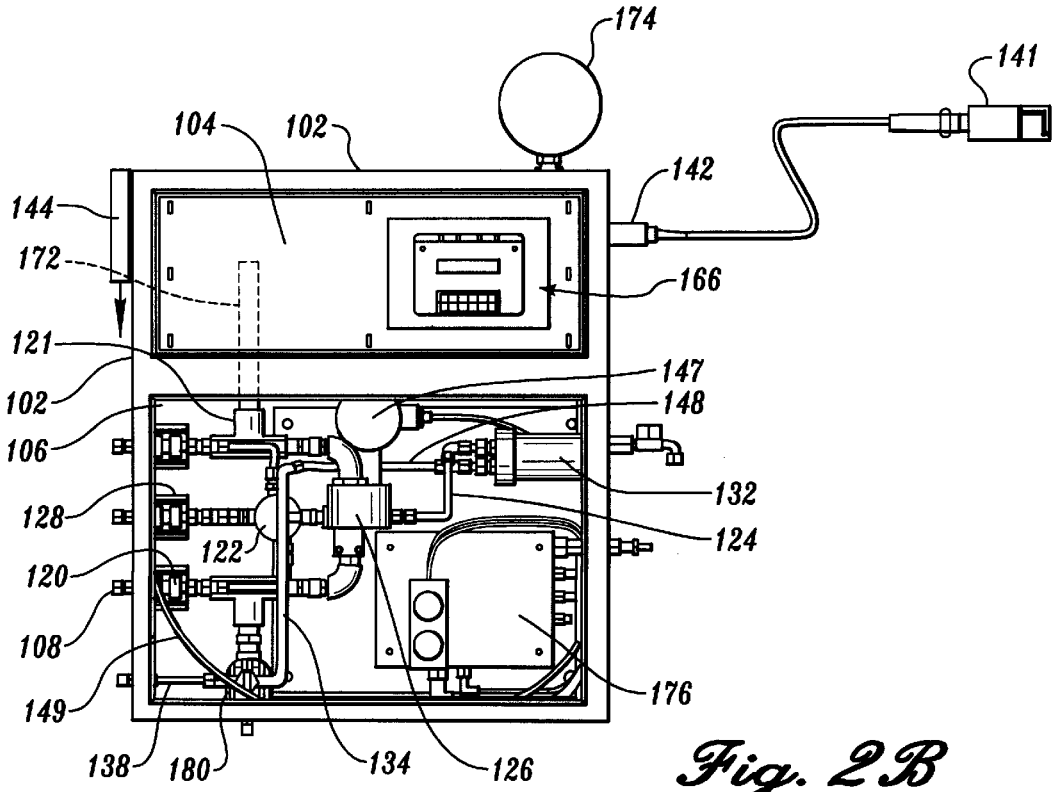
FIG. 2B is a front view of the mixer of FIG. 2A.

Shown in FIGS. 2A and 2B, the mixing system includes a rectangular housing 102 split into a pressurized upper compartment 104 and an insulated lower compartment 106. A control system 130 is positioned in the upper compartment 104. Referring to FIG. 2B, three solenoid valves 128, a reducing manifold 122, a flow meter 126, an integrator 132, and a static mixer 134 are all located in the lower compartment 106. Individual subcomponents containers (not shown) connect to air-operated double-diaphragm pumps (not shown) that provide pressurized fluid to input lines 120 located within the housing. The housing 102 includes plug-type ports 108 in its side walls for easy connection between container lines to the input lines 120.

Figure 3A:
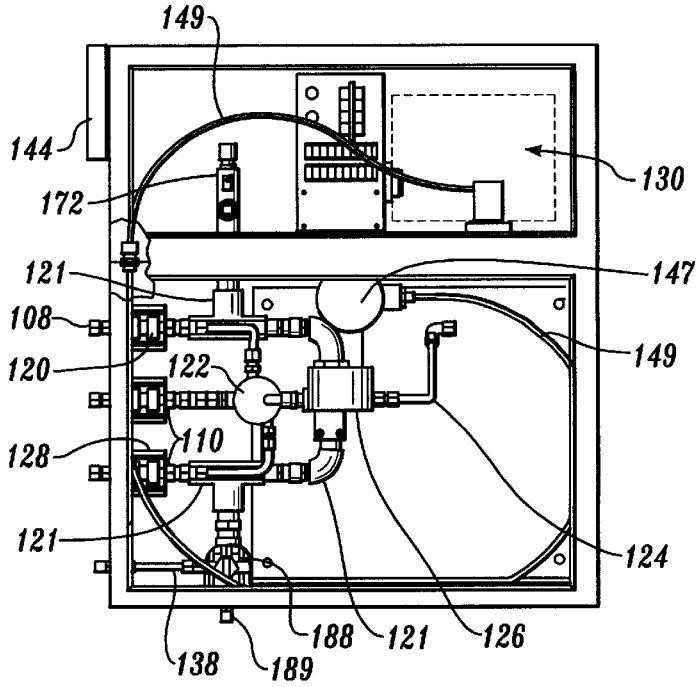
FIG. 3A is a front view of portions of the mixer shown in FIG. 2A.

Referring to FIG. 3A, the solenoid valves 128 are located along each input line 120 near the housing sidewall having the input ports 108. The solenoid valves communicate with the control system via wiring located in sealed wiring conduits 121. The control system includes a power supply unit 172 to which the valve wiring is directly connected. This allows the control system the ability to quickly shut off the mixing system if necessary. During normal use, the control system 130 switches the solenoid valves 128 on and off in a predetermined manner to form a continuous flow of alternating subcomponent fluid slugs in the manifold output line 124. An optional check valve 110 is connected between each solenoid valve and the manifold 122 to ensure there is no back flow of fluid through the input lines 120.

Still referring to FIG. 3A, the input lines 120 connect to the reducing manifold 122. The manifold includes three input passages designed to avoid direct erosion from opposite-facing fluid inlets, as shown best in FIG. 3D. A single manifold output line 124 passes fluid from the manifold output passage and through a single flow meter 126. The flow meter includes a fiber optic transmitter 147 connected to the control system 130 via a fiber optic link 149.

Figure 4A:
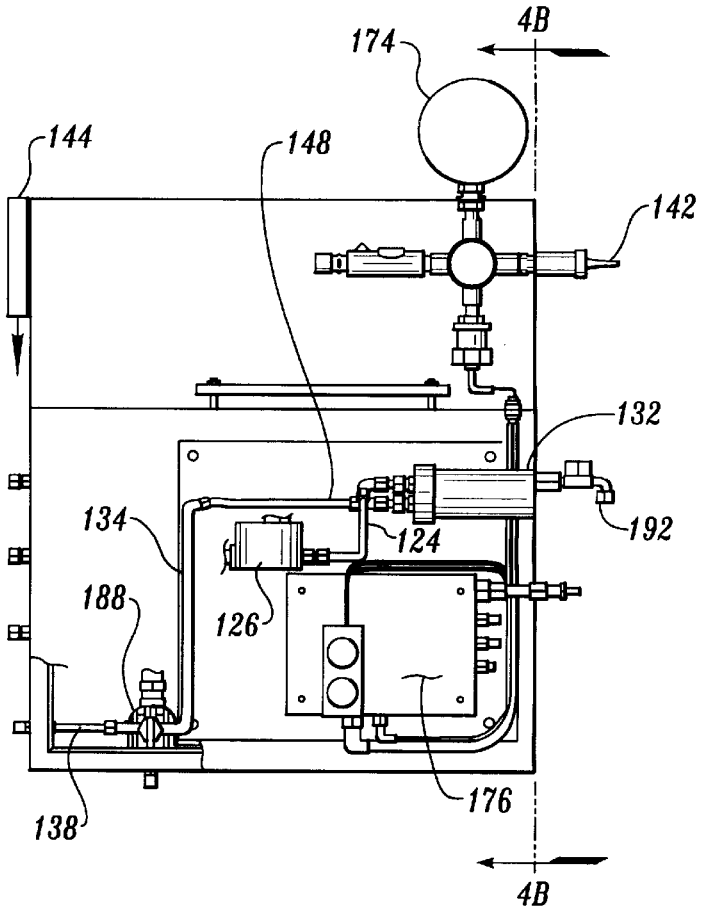
FIGS. 4A and 4B are front and end views of portions of the mixer shown in FIG. 2A.
Figure 4B:
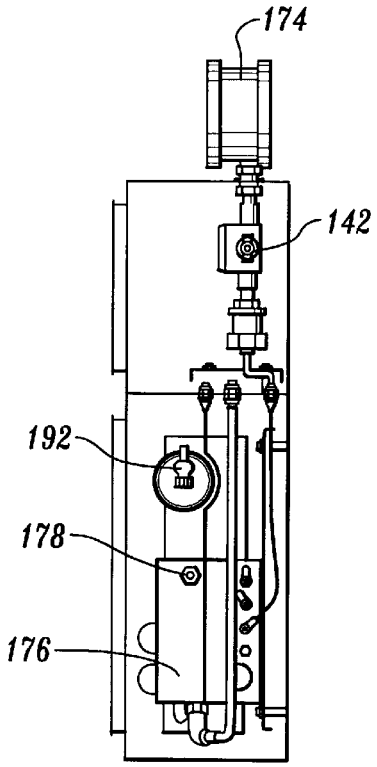

Referring to FIG. 4A, the slugs flow from the flow meter 126 into the integrator 132 where they are partially mixed. As shown in the detail drawing of FIG. 5, the integrator 132 is a cylindrical container 180 having first and second closed ends 182, 183. The integrator is positioned in the housing in a horizontal manner as shown. Constant thickness sidewalls 184 allow the container to accommodate pressure, in the range of about 100 psi to about 150 psi. An opening 188 in the second end 183 connects to a drain valve 192 located on the exterior of the housing lower compartment 106. The drain valve is for use in calibrating control system to account for the flow characteristics of each particular subcomponent fluid, as discussed above.

Figure 5:
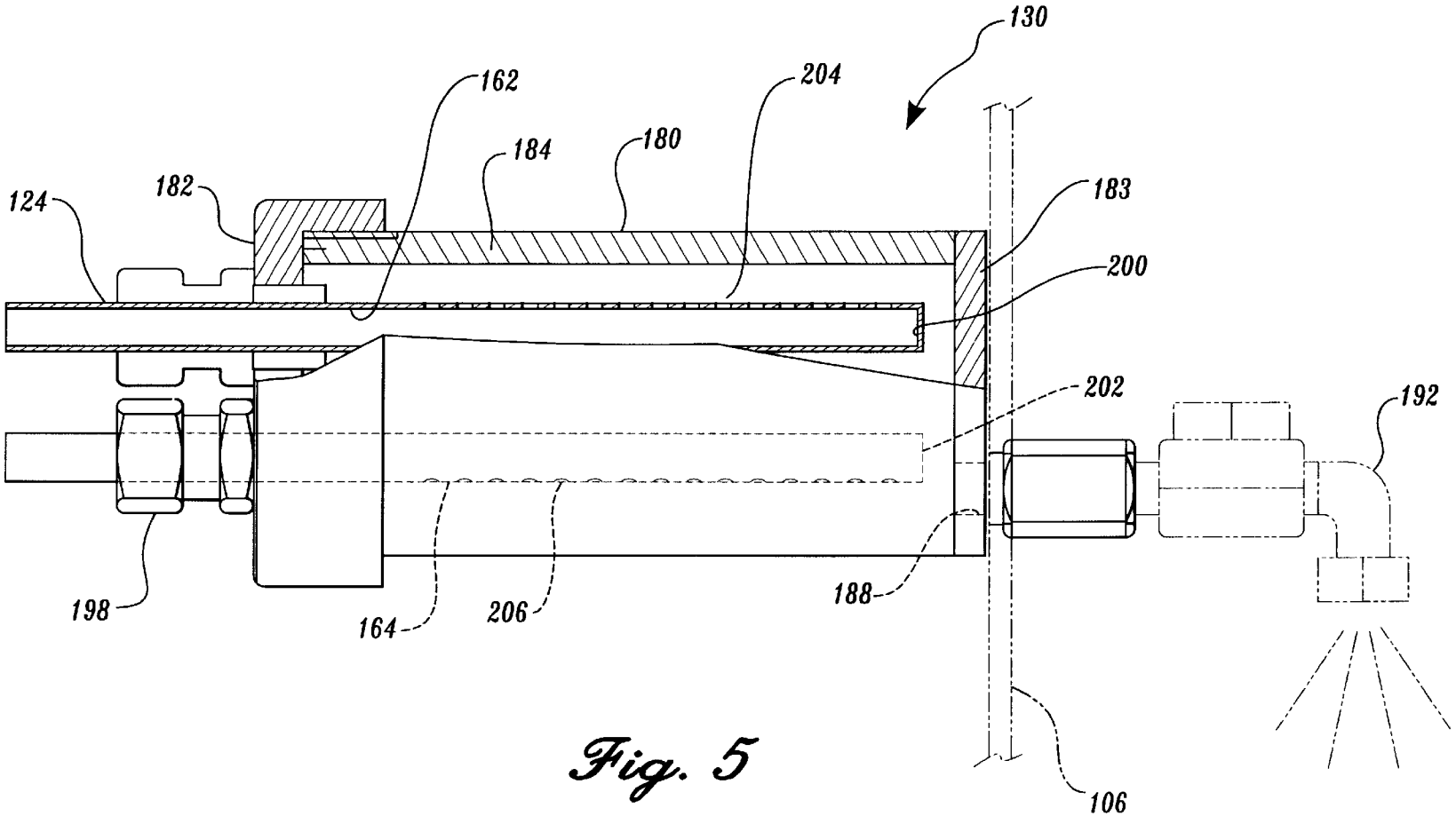
FIG. 5 is a partial cutaway side view of an integrator formed in accordance with the present invention with interior portions shown in phantom line.

Still referring to FIG. 5, the integrator 132 further includes influent and exfluent tubes 162, 164 that extend laterally into and out of the container first end 182 and connect to the output of the flow meter and the input of the static mixer 134, respectively. The preferred connections of the influent and exfluent tubes through the container 180 includes thermocouple connectors 198 or the like. The tubes 162, 164 has closed ends 200, 202 that terminate within the interior of the container at locations near the container second end 183. The portion of each tube that is positioned within the interior of the container 180 includes a plurality of deburred holes 204, 206. The influent tube holes 204 allow fluid to pass into the container 180 from the flow meter 126, while the exfluent tube holes 206 allow fluid to pass from the container 180 and eventually into the static mixer 134.

The influent tube holes 204 are aligned longitudinally along the influent tube and are oriented in a direction away from the exfluent tube 164. Similarly, the exfluent tube holes 206 are aligned longitudinally along the exfluent tube and are oriented in a direction away from the influent tube 162. This arrangement maximizes the distance that must be traveled by the fluid, which increases the mixing of the fluids. The diameter of each tube hole is calculated from the momentum equation and established empirical relationships. The hole diameters generally depend on the average pressure drop across the integrator as well as other factors known to those with skill in the art. Preferably, the influent tube holes 204 decrease nonlinearly in size in going to the closed tube end 200 to compensate for pressure recovery. Likewise, the exfluent tube holes 206 preferably increase nonlinearly in size in going to the closed tube end 202 to compensate for pressure loss. Generally, the greater the pressure available at the influent tube, the closer all holes approach a common diameter.

The embodiment of FIG. 5 uses hole diameter sizes calculated from the following equations:

$$d_n = \sqrt{\frac{4Q_n}{\pi V_{e_n}}} \tag{1}$$

$$V_{e_n} = 0.62\sqrt{\frac{2}{\rho}\left(\frac{p_n + p_{n+1}}{2} - p_e\right)} \tag{2}$$

$$p_{n+1} = k\rho(V_n^2 - V_{n+1}^2) + p_n \tag{3}$$

$$V_n = \frac{4(Q_1 - (n-1)Q_n)}{\pi d_t^2} \tag{4}$$

where $d_n$ is the diameter of each port, $Q_n$ and $V_{en}$ are the flow rate and velocity respectively through each port, $p_n$ is the pressure inside port n, $p_e$ is the discharge pressure outside the tubes, and ρ is the fluid density, $V_n$ is the velocity inside the tube before port n, k is an empirical constant, and $Q_t$ is the total flow rate to a tube with inside diameter $d_t$. For the embodiment shown in FIG. 5, k is equal to about 0.45 for the influent tube and 1.0 for the exfluent tube.

The integrator 132 of FIG. 5 can accommodate a flow rate of about two liters per minute for fluids in the range of approximately 1 centipoise to approximately 800 centipoise. The integrator volume is preferably about three times the largest combined slug micro-batch to provide good mixing and relatively small waste. For an exemplary ratio of 4:3:1 (base:flow:cure), and a minimum slug size of 10 ml (selected on the basis of the valve reaction time and the flow meter resolution), each batch will be 80 ml. This value multiplied by three is 240 ml. Thus the integrator of FIG. 5 is about 250 ml.

Referring back to FIG. 4A, the material flows out of the integrator through an integrator output line 148 that is connected between the integrator and the static mixer 134, where it is more thoroughly mixed. The static mixer 134 of the embodiment of FIGS. 2A–5 is a double helical type static mixer. The mixer includes a series of left- and right-hand helical elements which produce two fluid streams after each of twenty-four mix elements. The elements are formed from acetyl plastic, which is chemically compatible with most paint ingredients and inexpensive to manufacture.

The mixed fluid next moves through a static mixer output line 138 that is connected between the static mixer 134 and an application tool such as a spray gun (not shown). The static mixer output line 138 is of a length sufficient to provide any required final mixing and/or proportioning of the paint. A total output line length of 50 feet has been found to work in the embodiment of FIGS. 2A–5, while resulting in less than 2% error in mix ratio and roughly 1.5 pints of paint waste. (The line 138 shown in the embodiment of FIGS. 2A–5 is only a portion of the total line length.) It is recommended that the length of output line and the acceptability of its resulting mix ratio error be verified for each particular system design.

Figure 3B:
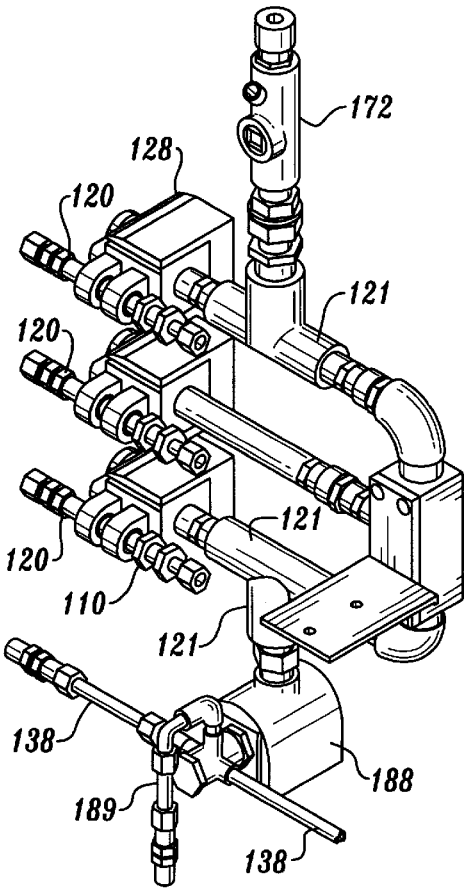
FIG. 3B is a detail perspective view of the valves shown in FIG. 2A.
Figure 3C:
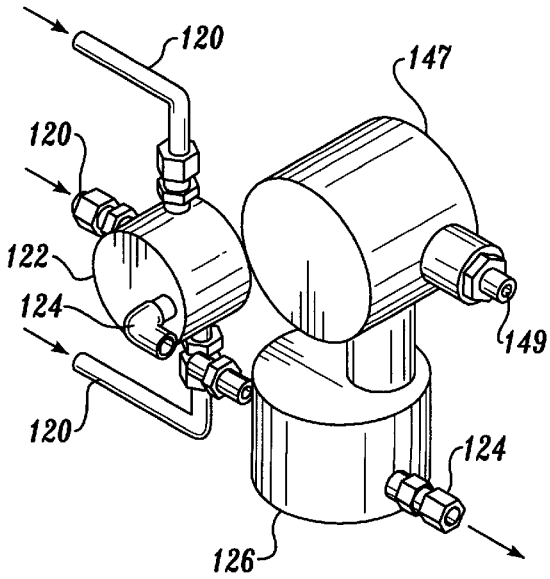
FIG. 3C is an exploded detail perspective view of the reducing manifold and flow meter shown in FIG. 2A.
Figure 3D:
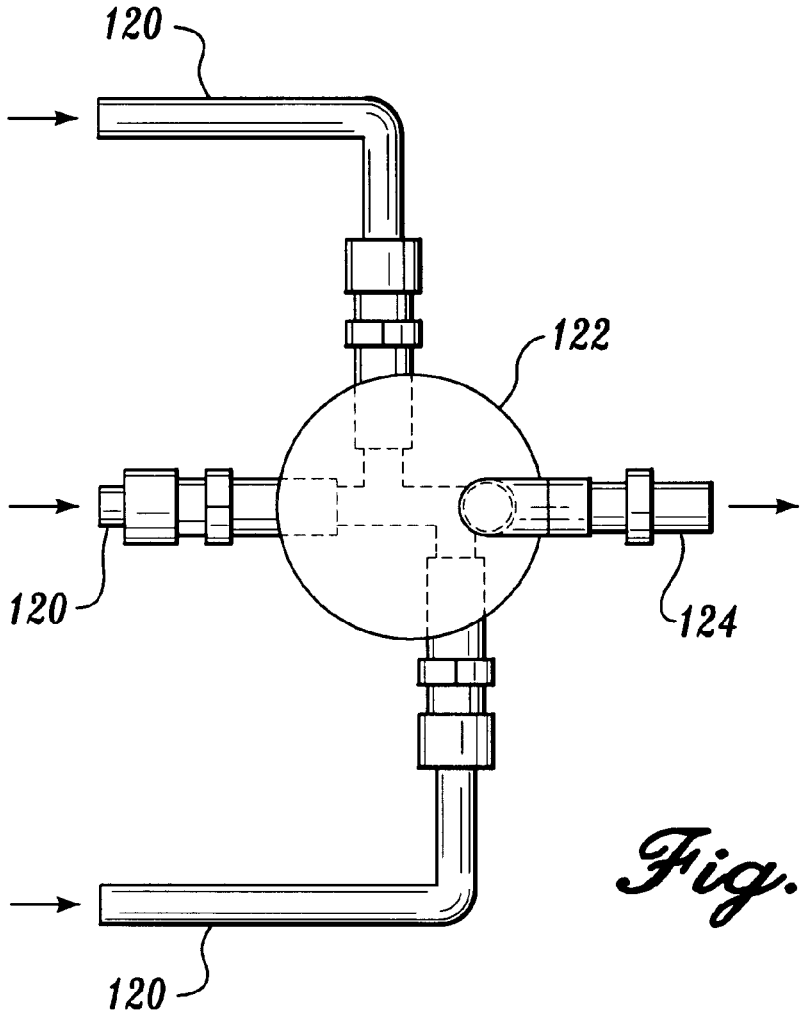
FIG. 3D is a detail view of the reducing manifold of FIG. 2A.

Referring particularly to FIG. 3B, a 3-way solenoid output valve 188 is connected to the static mixer output line 138. The valve 188 includes an alternate outlet passage that connects with a flush line 189. The valve is capable of allowing fluid to continue flowing through the static mixer output line 138, stopping fluid flow entirely, or directing fluid flow out the flush line 189. The valve 188 is controlled by the control system 130 using electrical wiring that is also located in the sealed wiring conduits 121.

The output valve 188 may additionally be used to clean the mixing system. When a particular painting project is complete, the base and cure component containers are disconnected from the housing. The flow container is left connected and pressurized. The integrator is drained via the drain valve 192. The control system is activated to cause the opening of all three subcomponent valves to initiate flow movement therethrough. The flow, acting as a solvent, back-flushes the cure and base materials from the manifold. This is done for a series of cycles, after which the base and cure valves are closed, their input ports 108 are sealed off, and the rest of the system is purged by opening the output valve 188 and allowing flow to pass through the remaining system mechanisms. The waste solvent is collected and disposed of properly.

The mixing system of FIGS. 2A–5 is calibrated as discussed above. For stable mixing systems, calibration coefficients may alternatively be used in lieu of calibration, where the coefficients are determined based on established fluid viscosity and operating temperature relationships, or through periodic manual verification. For fluid handling, most metals are acceptable materials of construction for the present invention mixing system. Example metals include cast iron, steel, stainless steel, brass, and aluminum. The most useful compatible plastics and elastomers include Teflon, acetyl, nylon, ethylene-propylene rubber, and most forms of polyethylene and polypropylene.

Referring to FIG. 2B, the control system includes a controller 166 that is connected to the power supply unit 172. The system is powered by 120 Volts AC wall current provided through a conventional electrical plug 141 into a connection fitting 142 attached to the housing upper compartment sidewall. An explosion-proof receptacle is interconnected between the connection fitting 142 and the power supply unit 172. A step down transformer converts the current to 12 Volts DC which is then supplied to the controller. Various other electrical components are provided as needed. The power supply unit 172 is connected to the sealed wire conduits 121 that stem from the subcomponent valves 128 and the output valve 188. The controller 166 is further in electrical communication with the flow meter 126 via a fiber optic cable 148.

In this embodiment, various parameters and functions are pre-programmed within the controller 166 using a Z180 chip of C programmable memory. Instruction to perform a particular task may be manually entered using a display screen 150 or preferably may be supplied to the controller 166 via a personal computer (see generic item 68 in FIG. 1A) and modem 170 using a preprogrammed computer instruction system having a layered menu structure. One embodiment of an instruction system is described below with reference to FIGS. 6–10. Other control systems may be used.

To avoid the risk of fire, the upper compartment 104 is sealed and positively pressurized. All electrical wiring and connections within the lower compartment 106 are insulated to avoid any contact with flammable paint subcomponents or subcomponent fumes. Preferably, the entire housing 102 is a NEMA 4X enclosure that is designed to be resistant gas, dust, and fluids. Referring to FIG. 4A, a conventional air purge unit 176 is provided to continuously purge and pressurize the upper compartment. The unit continuously blows air from a shop air supply 178 (source not shown) into the upper compartment. A pressure relief valve 144 functions as an exit for purge air.

Before applying power, the upper compartment preferably experiences a minimum of four volume change-overs after which a pneumatic signal is sent to an explosion-proof switch to energize the system. A pneumatic pressure sensor monitors the pressurization of the upper compartment and relays the information to the control system and/or the air purge unit 176. If a purge failure is detected or if a stable pressure is not maintained in the upper compartment, the purge unit 76 alerts the user by pneumatically activating an explosion-proof alarm 174. The purge unit 76 further removes power to the control system thereby aborting all functions until the failure is corrected or the system is reset.

Figure 6:
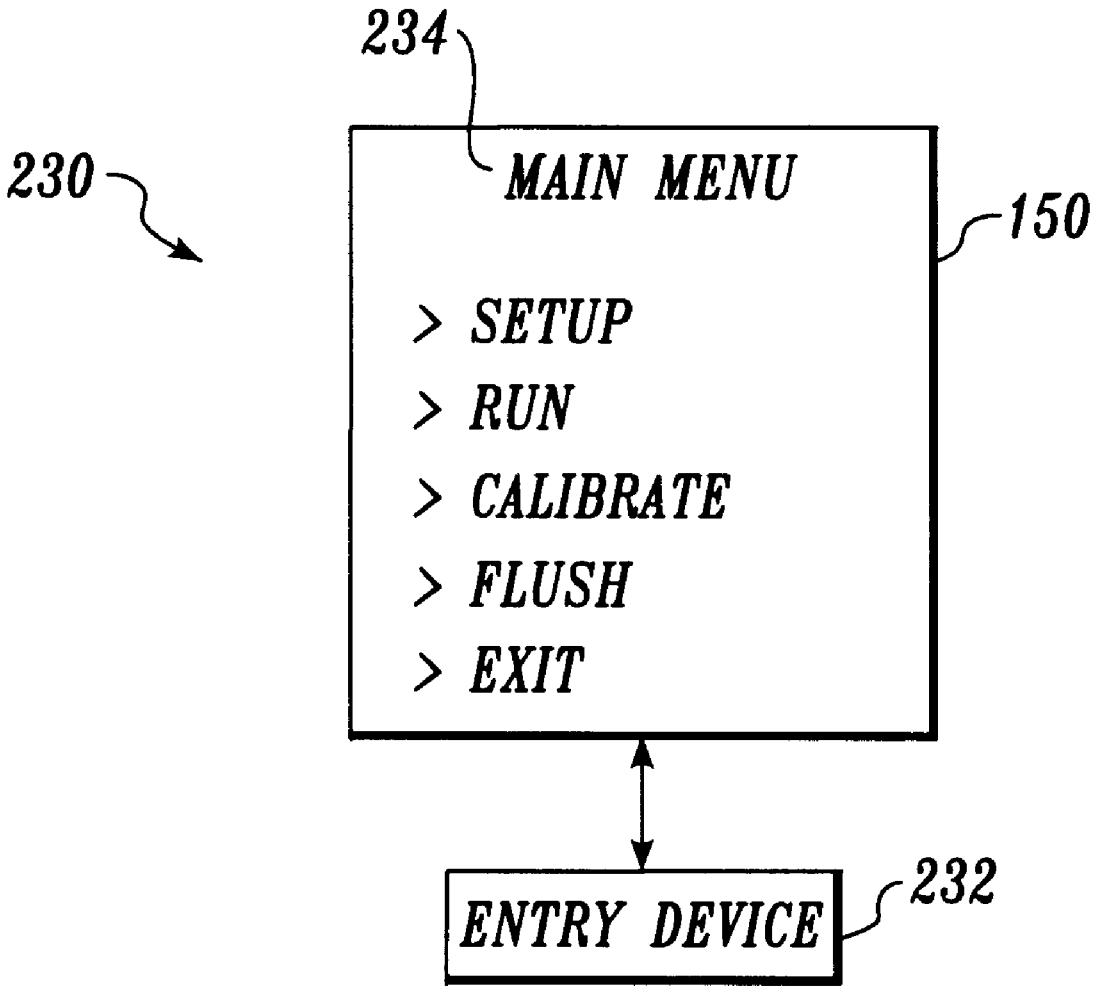
FIG. 6 is an illustration of a Main Menu an instruction system formed in accordance with the present invention.

One embodiment of an instruction system 230 for providing instructions to the controller via the computer and modem, is illustrated in FIGS. 6–10. Referring to FIG. 6, the operator uses a data entry device 232 to select a task that is shown on the computer display screen 150. The data entry device is a keyboard, touchpad, lightpen, voice monitor, mouse, or the like. The instruction system 230 organizes the tasks using a layered menu structure. As illustrated, the highest layer is a Main Menu 234 that includes the keywords "SETUP", "FLUSH", "RUN", and "CALIBRATION". Each keyword represents an available task. Other keywords may be implemented as required for a particular application.

The SETUP task allows the user to modify various variables that will be used by the control system in determining mix ratio, mechanism calibration, error tolerances, etc. The instruction system FLUSH task provides an automated method of flushing the mixing system components. The RUN task is the central feature of the instruction system 230 and of the control system 130. The RUN task generates the control system commands that cause the input valves to open and close, thus forming the slugwise line of subcomponent fluids in the proper amounts. The CALIBRATION task provides an automated method of calibrating the mixing system and/or allowing the user to calibrate the system.

The instruction system is implemented in computer code and is initiated by the computer when either the unit is plugged in and powered up or when the on/off switch is turned on. Once started, the Main Menu is the predominant display of the system, and is either inactive but ready to operate, or operating by accomplishing a selected task. The user exits a particular task at any time by selecting a dedicated exit key (e.g., the escape key on a typical keyboard.) If the exit key is selected, the instruction system will then update computer memory as appropriate and return the user to the Main Menu. In some instances, the exit key takes the user only to the previous menu. Multiple exit selections will eventually place the instruction system back at the Main Menu.

The system 230 includes a full set of default values. Should the user wish to alter these values, the user will select the SETUP task from the Main Menu 234. Referring to the logic diagram of FIG. 7A, the instruction system starts the setup logic at step 235 and begins by displaying a Setup Menu (i.e., another task selection menu) at step 236. The choices from the Setup Menu include "NEWDRUM", "RATIO", "RATIO TOLERANCE", "CALIBRATION COEFFICIENT", and "DISPLAY".

Upon selection of the NEWDRUM task, the query at step 238 results in the system moving to step 240 to determine the size of the new subcomponent container and to determine the low volume threshold amount. These determinations are preferably accomplished by asking the user to enter the data using the display screen and the data entry device 232. The instruction system then proceeds back to the Setup Menu where it awaits the user's next Setup Menu selection. If the user selects the RATIO task, the query at step 242 results in the system determining the desired mix ratio at step 244, again, preferably by asking the user to enter the data using the data entry device. Once obtained, the system returns to the Setup Menu. Should the user have selected the RATIO TOLERANCE task, the query at step 246 causes the instruction system to determine the level of error that is acceptable to the user for the given mix ratio at step 248 by inviting the user to enter the error value. Once obtained, the system again returns to the Setup Menu.

Upon selection of the CALIBRATION COEFFICIENT task, the query at step 250 results in the instruction system determining the calibration coefficients for one or more of the subcomponents by asking the user to enter new coefficients. This is a particularly useful feature when the viscosities of the subcomponents vary greatly relative to one another or have significant sensitivity to temperature changes. Because this information can be so important to the control system in forming a paint with the proper mix ratio, it is preferred that the instruction system require a password prior to allowing the operator to alter these values. If the password is satisfied, the determination of coeficients is accomplished at step 252 by having the user enter the data via the data entry device.

Upon selection of the DISPLAY task, the query at step 254 causes the instruction system to display a Display Menu on the screen, providing yet another level of tasks from which the user is to select. See FIG. 7B. For each of the queries 238, 242, 246, 250, and 254, in FIG. 7A a "no" answer results in the system cycling through the queries until a "yes" response is received (or until the user hits exit.) During this cycling, the display screen continues to show the Setup Menu.

Figure 7A:
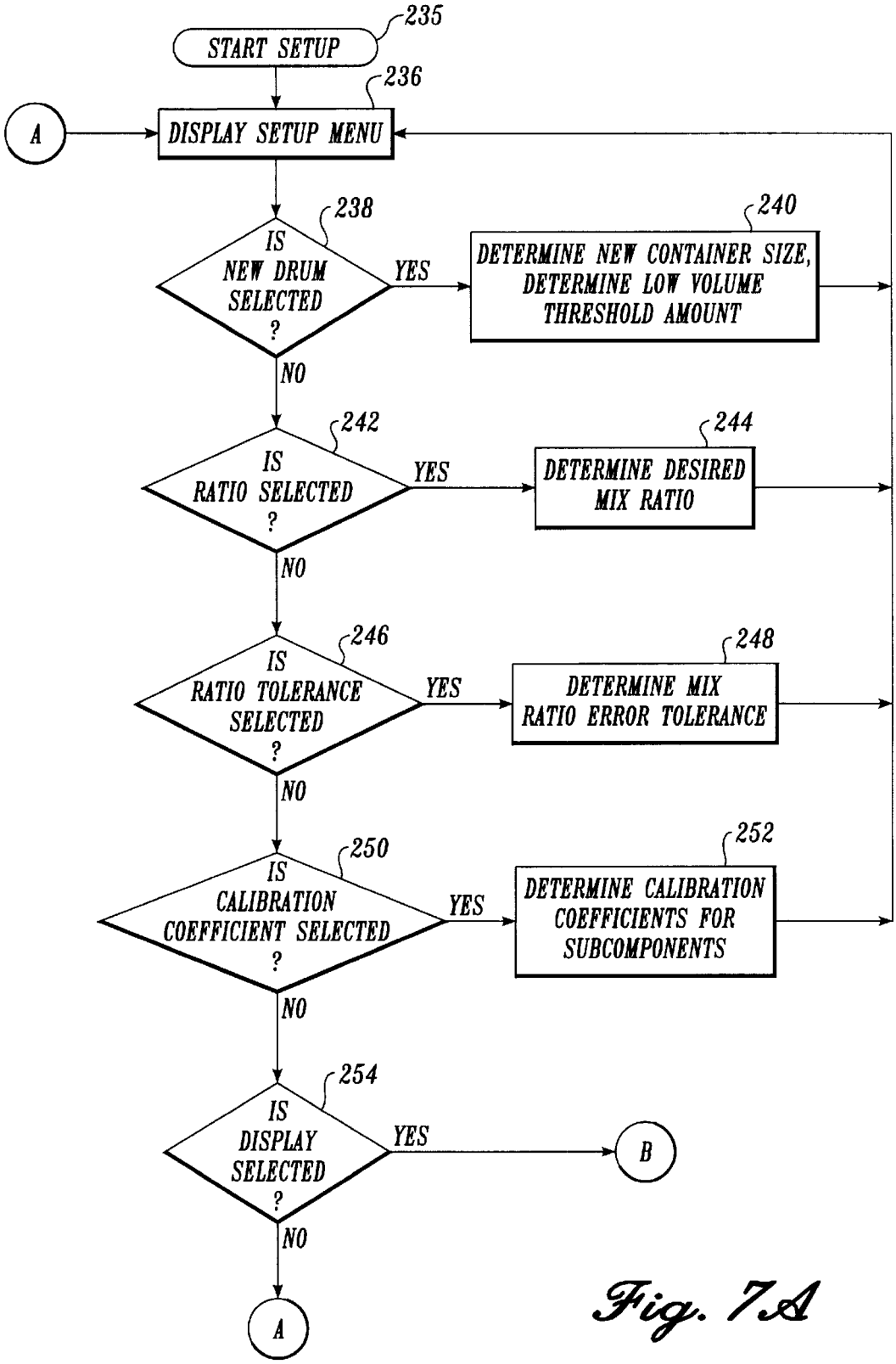
FIGS. 7A and 7B are logic diagrams of the Setup selection listed in FIG. 6.
Figure 7B:
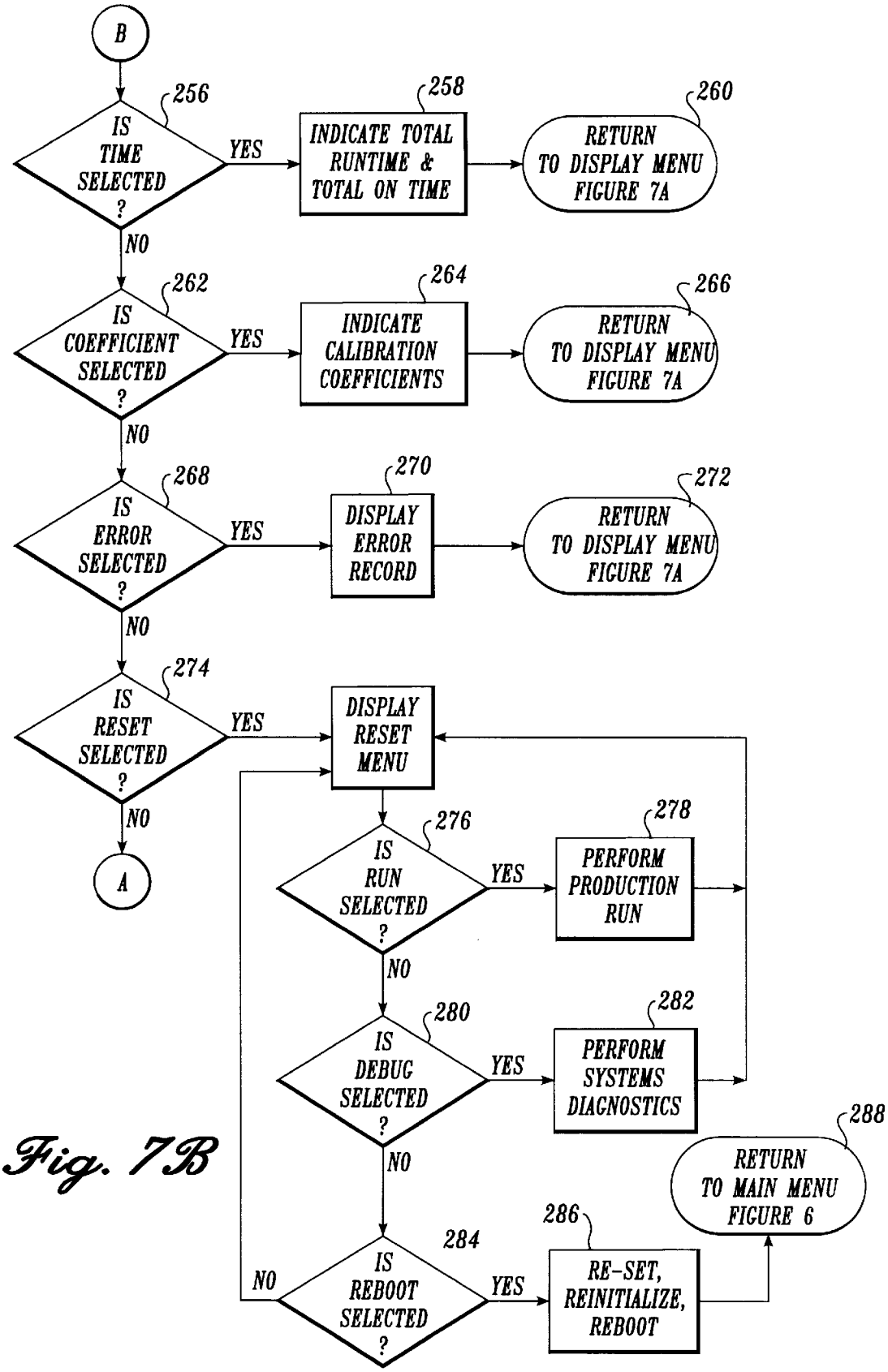

Referring to FIG. 7B, the choices from the Display Menu preferably include "TIME", "COEFFICIENT", "ERROR", and "RESET". When the user selects the TIME task from the Display Menu, the query at step 256 causes the system to indicate the total cumulative time that the mixing system has been in run mode since it was built (similar to a chronometer) at step 258. The system also displays the total cumulative time the mixing system has been powered on but not necessarily running since it was built. The run time is useful for indicating solenoid and flow meter wear for maintenance purposes. The on-time is useful for indicating cumulative on-time for the electronics. If the user selects COEFFICIENT from the Display Menu, the query at step 262 results in the instruction system indicating the current subcomponent calibration coefficient values at 264. If the user selects ERROR, the query at step 268 causes the system to display the error record from computer memory at 270. After the values at steps 258, 264, and 270 have been shown, the system returns the user to the Display Menu (at steps 260, 266, 272, respectively) either automatically or in response to a user command (such as the Enter or Exit keys being pressed.)

Upon selection of RESET, the query at step 274 preferably asked the user to prove authorization to reset the system, by asking the user for the correct password (step not shown). Once the correct password is entered, the system displays a Reset Menu including the tasks of "RUN", "DEBUG", and "REBOOT".

The instruction system can preferably run in two separate operating modes. In a production mode, the instruction system monitors the flow meter and switches the subcomponent input valves appropriately in response. In a debug mode, the instruction system creates an internal (or dummy) counter in lieu of the flow meter. This causes the selection of the RUN task from the Main Menu to run only the valves. Therefore, the debug mode allows the user to check the functioning of the mixing system components without any actual fluid passing through the valves or the flow meter.

Still referring to FIG. 7B, if the RUN task is selected from the Reset Menu, the query at step 276 results in the instruction system being set to the production mode at step 278. The system preferably indicates the RUN mode status, for example by displaying "RUN MODE" or some other indicia to the viewer on the display screen. If the DEBUG task is selected, the query at step 280 results in the instruction system being set to the debug mode at step 282. If DEBUG is selected, the system preferably also indicates the experimental state of the control and mixing systems to the user. After setting the operating mode, the system returns the user to the Reset Menu. If the REBOOT task is selected, the query at step 284 results in the instruction system resetting the control system by re-initializing all of its user-modifiable values to their default amounts at step 286. The instruction system further reboots the control system and finally returns the user to the Main Menu at step 288.

Figure 8:
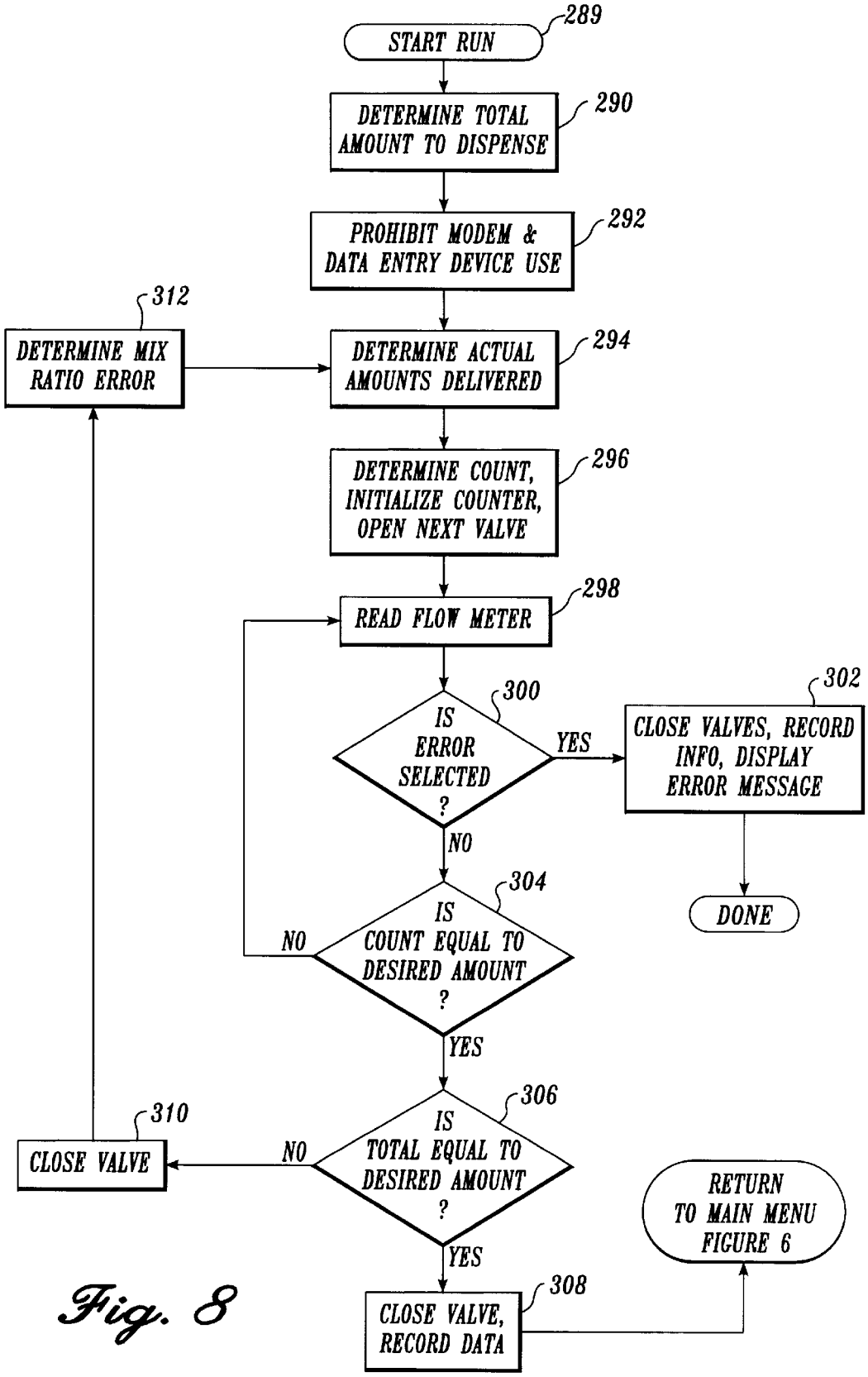
FIG. 8 is a logic diagram of the Run selection listed in FIG. 6.

Referring to FIG. 8, the RUN task is the central feature of the instruction system 230 and the control system 130. The RUN task generates the control system commands that cause the input valves to open and close, thus forming the slugwise line of subcomponent fluids in the proper amounts. When the user selects RUN from the Main Menu, the system starts at step 289 and begins by determining the total amount of mixed fluid to dispense at step 290. In a preferred embodiment, the determination is made by asking the user to enter the desired total amount using the data entry device. (Alternatively, step 290 may be omitted and a direct launch of the RUN task initiated for unlimited sprayout.) After the total amount desired is obtained, the system disallows further disruption from either the modem or the data entry device (except for the exit or escape key.) This last feature may be omitted depending on the computing capabilities of the computer being used.

The first time through the run task logic for a particular mixing job, the system preferably bypasses step 294 and continues to step 296 to set a specific count for each of the subcomponents to be mixed. Each subcomponent count corresponds to the number of pulses to be received from the flow meter as it meters fluid through the manifold output line. For example, if a base:flow:cure mix ratio is 4:3:1 with the smallest slug size being 10 ml and the flow meter pulsing at every milliliter, then the instruction system would set the count for the first subcomponent at 40, the count for the second component at 30, and the count for the third component at 10. If the system is cycled as suggested above with a portion of flow being passed between portions of base and cure, then the instruction set would determine that it needs to receive 40 pulses of the first component (i.e., base), 15 pulses of the second component (i.e., flow), 10 pulses of the third component (i.e., cure), and 15 more pulses of the second component (i.e., flow).

Having determined the proper counts, the instruction system relays to the other control system components the command to open the first valve. Once a valve is open, and fluid is flowing, the flow meter will begin sending pulses to the control system as fluid passes through the flow meter. The instruction system keeps track of the pulses from the flow meter to determine whether the appropriate amount of fluid has been delivered. To count flow meter pulses, a high frequency direct memory access (DMA) counter is used. As a backup, a second DMA counter is used to compare against the first counter. The system checks for various errors at step 300, including any discrepancies between the two counters. If the two DMA counters agree within a tolerance, continued operation is allowed. If there are any unacceptable errors at query 300, the instruction system causes the input valves to close, all relevant data to be captured in computer memory, and an error message to be displayed at the display screen (at step 302.)

If there are no unacceptable errors, the instruction system continues to step 304 where a determination is made at query 306 as to whether the count has been attained for the particular valve input line that is currently running. If not, the logic returns to step 298 where the flow meter pulses are read by the DMA counters. If the proper count has been reached, the system checks whether the total amount of fluid having been passed through the flow meter equals the total amount of paint requested in step 290. If so, the valve is closed, the appropriate data is stored in memory, and the system is returned to the Main Menu at step 308.

When the query of step 306 is false, then the valve is closed at step 310. If a complete cycle of subcomponents has passed through the system, the error in mix ratio is determined at step 312 using actual metered amounts (as opposed to the intended metered amounts determined in step 296.) Actual metered amounts are determined in step 294 (after the first valve opening) in which the system checks the counters for any valve overruns that may have occurred after the valves that were last open had supposedly closed.

In this manner, the various subcomponents are cycled through the flow meter until the total amount of paint is formed. This critical loop preferably contains redundant error monitoring checks so that all error conditions will be detected. Even in case of a power brownout, where it is possible for program code to become corrupt, diagnostics are available to prevent erroneous operation. Upon detecting a failure of any type, the controller shuts down all valves and prints a message to the screen to define and help troubleshoot the problem.

Referring to the logic diagram of FIG. 9, the instruction system begins calibration at step 315 upon user selection of the CALIBRATION task from the Main Menu. The CALIBRATION task provides an automated method of calibrating the mixing system and/or allowing the user to calibrate the system. If the calibration task is automated, the user simply selects the subcomponent to calibrate and the instruction system flows a predetermined amount and types of fluid. Otherwise, the calibration logic requires the user to stop the system in order to stop the flow of subcomponent through the flow meter. The later method is represented by FIG. 9.

At step 316, the instruction system determines which subcomponents are to be calibrated by asking the operator to enter the subcomponent via the display screen and/or data entry device. At step 320, the system then determines an appropriate count for calibrating that subcomponent, initializes the flow meter DMA counters to zero, and opens the proper subcomponent input valve. After the DMA counters read the flow meter at step 322, a query is made at step 324 regarding whether any errors have been detected. If so, the system closes all valves, records various data in computer memory, and displays an error message to the user on the display screen at step 326.

If no errors have been detected, the system further checks to determine if any stop commands (e.g., from an escape key, an enter key, etc.) have been received at step 328. If not, the system returns to read the flow meter again at step 322. If a stop command is received, the system asks the user to enter the volume of material flowed. The user obtains this value by actually measuring the amount of fluid that passed through the flow meter. The system then determines the difference between the DMA counter values and the entered independent value at step 332. The system also determines the calibration coefficients and records various other pieces of data. If the calibration coefficients are within a band of acceptable values at step 334, the system indicates to the user that the subcomponent is calibrated and the value of its coefficient at step 336. The system determines whether there are further components to calibrate at step 335. If not, it returns the user to the Main Menu. If so, the next component is calibrated.

If the calibration coefficients are not within a band of acceptable values, the query at 334 results in the system indicating such to the user at step 338 and asking the user if he or she would like to re-enter their independent measured value (at 340.) If so, the system returns to step 330. If not, the system asks the user if he or she would like to try again at question 342.

Figure 10:
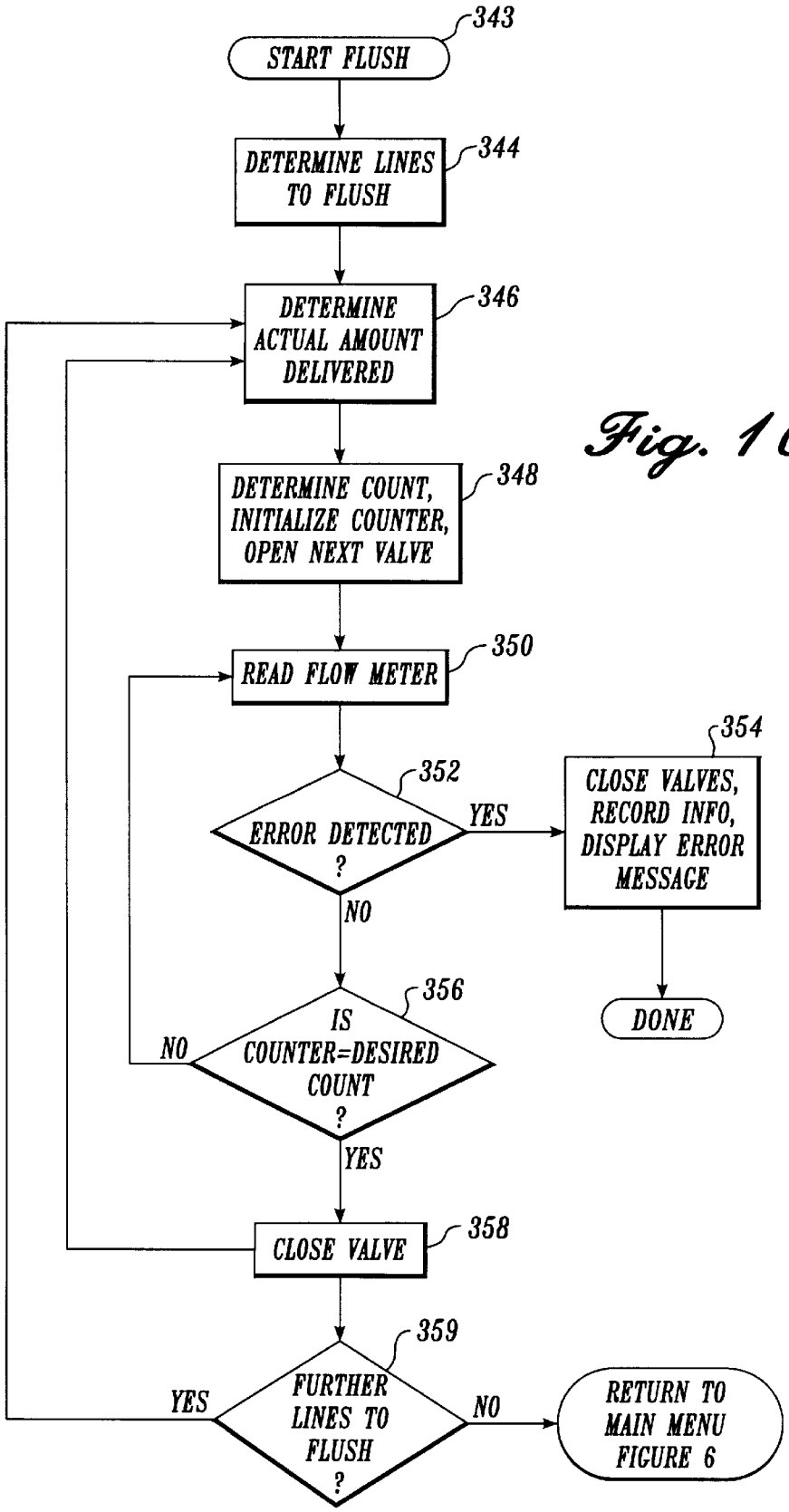
FIG. 10 is a logic diagram of the Flush selection listed in FIG. 6.

Referring to FIG. 10, the mixing system is automatically flushed by selection of the FLUSH task from the Main Menu. The system starts at step 343 and begins by determining the lines to be flushed at step 344, either by recalling the lines last used, or by having the user identify the appropriate lines. In preferred embodiments, the system assumes that all lines are to be flushed. The first time through this portion of logic, step 346 is passed, and the system moves to step 348 to determine the pulse count (preferably three times the minimum slug size), initialize the DMA counters to zero, and to then open the correct valve.

The DMA counters read the flow meter pulses at step 350, and the query at 352 asks whether any type of error is detected. If an error is found, the system closes all valves, records the relevant data in computer memory, and displays an error message on the display screen at step 354. If no errors are found, the system determines whether the DMA counter is equal to the desired count at investigation 356. A false answer results in the return to step 350 to again read the flow meter and investigate errors at step 352. A true answer results in the system closing that valve at step 358 and returning to step 346 where the system determines and records the actual amount of fluid flushed. If further lines are to be flushed, it is determined at question 359. If not, the system returns to the Main Menu.

The instruction system further includes logic to stop all mixing system operations under certain conditions. For example, the system shuts down if the purge pressure drops below a threshold value. This pressure is independently monitored by the purge unit—not the controller. The system may also shut down if the paint mix ratio exceeds an allowable tolerance. In addition to the above features, there are other desirable tasks that the instruction system can accomplish, e.g., determining and indicating when a fluid container is near depletion.

As will be appreciated from a reading of the above, the present invention mixing system provides a number of benefits over current paint mixing system. The mixing system uses mechanisms that are inexpensive to acquire, operate, and maintain. The system is capable of thoroughly mixing any number of subcomponents in the desired mix ratio without the need for batch mixing. In contrast with known in-line mixing systems, the present invention uses only one flow meter for all subcomponents, thereby further reducing system cost.

Adding more subcomponents can be accomplished by manifolding in an additional valved input line and redesigning the integrator, static mixer, and control system as appropriate. This flexibility allows the present invention to mix conventional and high solids paint formulations in multiple component configurations. It also allows an operator the option of attempting more complex paint mixing tasks, such as color tinting or fluid formulations with three, four or more subcomponents.

The mixing system further reduces the volume of waste and its associated costs in the production of painted aircraft and to the environment. It uses less material supplies and allows the raw paint subcomponents in closed containers, such as bags, to be used for the next application. Finally, the mixing system may be used in configurations other than a precision point-of-use mixer, such as a bulk dispenser where bulk material is centrally metered, mixed, dispensed and distributed.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of instruction for use in controlling the mixing of paint subcomponents in a mixing system having input valves, a single flow meter, and a control system; one input valve being provided to correspond to each paint subcomponent; the subcomponents being in fluid communication with the single flow meter, with entry into the single flow meter occurring through each corresponding input valve; the control system being in communication with the input valves and the single flow meter; the method comprising providing a computer display menu having at least a RUN task selection, where upon selection of the RUN task the method further includes:

(a) determining a total amount of paint to dispense;

(b) determining an amount and a sequence of each paint subcomponent to dispense;

(c) causing the control system to dispense each subcomponent in its determined amount and sequence by opening and closing each corresponding input valve and by measuring the amount of each subcomponent dispensed using the single flow meter; and (d) tracking the amount of subcomponent dispensed to determine when the total amount is reached.

2. The method according to claim 1, wherein the method further includes calculating an actual mix ratio of the amount dispensed.

3. The method according to claim 1, wherein the paint subcomponents include base, flow, and cure, and the dispensing of each subcomponent includes dispensing so that the subcomponents of base and cure are separated in the single flow meter by the subcomponent flow.

4. The method according to claim 1, wherein the menu further comprises a SETUP task selection, where upon selection of the SETUP task the method further includes determining at least one of a mix ratio, a mix ratio error tolerance, a calibration coefficient, a subcomponent container size, and a low volume threshold.

5. The method according to claim 4, wherein the method further includes displaying at least one of a total run time, a total on time, a calibration coefficient, and an error record.

6. The method according to claim 1, wherein the menu further comprises a CALIBRATE task selection, where upon selection of the CALIBRATE task the method further includes:

(a) determining a subcomponent to be calibrated:

(b) opening the corresponding subcomponent input valve to pass subcomponent fluid through the flow meter;

(c) determining the amount of subcomponent fluid dispensed as measured by the flow meter;

(d) determining the amount of subcomponent fluid dispensed as measured independently; and (e) differencing the metered flow amount with the independently measured amount to determine an error amount and forming a calibration coefficient.

7. The method according to claim 6, wherein the independently measured subcomponent fluid amount is determined by collecting the dispensed subcomponent fluid from the mixing system and measuring it separately.

8. The method according to claim 6, wherein the paint subcomponents include base, flow, and cure, and the dispensing of each subcomponent includes dispensing so that the subcomponents of base and cure are separated by the subcomponent flow.

9. The method according to claim 6, wherein the method further includes calculating an actual mix ratio of the amount dispensed.

10. The method according to claim 6, wherein the menu further comprises a FLUSH task selection, whereupon selection of the FLUSH task the method further includes determining which portions of the mixing system are to be flushed, determining an appropriate amount of solvent to use for each portion to be flushed, and causing solvent to be passed through each portion in the appropriate amount.

11. The method according to claim 6, wherein the method further includes determining whether the error amount is within a tolerable amount.

12. The method according to claim 6, wherein the method further includes displaying the calibration coefficient.

13. The method according to claim 1, wherein the menu further comprises a FLUSH task selection, whereupon selection of the FLUSH task the method further includes determining which portions of the mixing system are to be flushed, determining an appropriate amount of solvent to use for each portion to be flushed, and causing solvent to be passed through each portion in the appropriate amount.

* * * * *